US006158961A

United States Patent [19]

Kehl et al.

[11] Patent Number: 6,158,961

[45] Date of Patent: Dec. 12, 2000

[54] TRUNCATED CHAMFER TURBINE BLADE

[75] Inventors: Richard E. Kehl, Niskayuna, N.Y.; Gurmohan S. Baveja, Mentor, Ohio

[73] Assignee: General Electric Compnay, Cincinnati, Ohio

[21] Appl. No.: 09/170,173

[22] Filed: Oct. 13, 1998

[51] Int. Cl.[7] ..... F01D 5/30

[52] U.S. Cl. ..... 416/193 A; 416/219 R; 29/889.7; 29/527.6

[58] Field of Search ..... 416/193 A, 190, 416/248, 219 R, 220 R; 29/889.7, 527.6

[56] References Cited

U.S. PATENT DOCUMENTS 4,714,410 12/1987 Hancock ..... 416/193 A
5,160,242 11/1992 Brown ..... 416/193 A
5,299,353 4/1994 Nazmy et al. ..... 29/889.7
5,478,207 12/1995 Stec ..... 416/219 R
5,511,945 4/1996 Glezer et al. ..... 416/219 R

*Primary Examiner*—F. Daniel Lopez
*Assistant Examiner*—Richard Woo
*Attorney, Agent, or Firm*—Andrew C. Hess; Rodney M. Young

[57] ABSTRACT

A gas turbine blade includes an airfoil, platform, and dovetail. The blade is cast with a chamfer along one edge of the platform thereof. The platform edge is then machined to truncate the chamfer in a simple and precise method.

19 Claims, 3 Drawing Sheets

TRUNCATED CHAMFER TURBINE BLADE

BACKGROUND OF THE INVENTION

The present invention relates generally to gas turbine engines, and, more specifically, to turbine rotor blades therein.

A typical gas turbine engine includes a compressor for pressuring air which is mixed with fuel in a combustor and ignited for generating hot combustion gases which flow downstream through a turbine which extracts energy therefrom for powering the compressor. The turbine includes a plurality of circumferentially adjoining rotor blades extending radially outwardly from the perimeter of a supporting disk.

A typical turbine blade includes an airfoil having a generally concave pressure side and an opposite, generally convex suction side extending axially between opposite leading and trailing edges which extend radially from a root to tip of the airfoil. The blade also includes a platform integrally joined to the root of the airfoil which defines a radially inner flowpath boundary for the combustion gases. Extending radially below the platform is an integral dovetail which slidingly engages a complementary dovetail slot extending axially through the rotor disk for retention of the blade during operation.

The turbine blades and rotor disk require precise dimensions for maximizing aerodynamic efficiency of the turbine and limiting stress during operation from centrifugal force, pressure loads, and thermal gradients;. However, since the turbine blades and disk are individually manufactured, they are subject to statistical variation in their dimensions, including statistical variation in stack-up tolerances when the blades are assembled into the disk.

For example, the individual blade platforms collectively define the radially inner flowpath for the combustion gases channeled over the turbine airfoils. The radial location of the outer surface of the platforms from the axial centerline axis of the turbine varies randomly from platform to platform around the circumference of the disk. Accordingly, some platforms are radially higher than adjacent platforms and some are radially lower, and in both situations effect differential steps therebetween along the circumferential side edges of the platforms. As the combustion gases engage the steps, aerodynamic efficiency may be adversely affected, and the protruding steps are locally heated by the hot combustion gases. This local heating can adversely affect the useful life of the blades and is undesirable, especially for turbines operated at ever increasing combustion gas temperatures.

The adverse affect of the steps is ameliorated by providing a chamfer which extends along both circumferential side edges of the individual platforms. The chamfers provide relatively smooth transitions from platform to platform notwithstanding the small differences in radial position of the adjacent platforms. Such chamfered turbine blade platforms have enjoyed many years of successful commercial use in this country. However, the chamfers require additional manufacturing steps and cost and introduce yet another feature which must accurately controlled during manufacture.

More specifically, modern turbine blades are relatively complex and expensive to manufacture since they are typically made of high temperature, high strength superalloy materials. The blades are typically hollow and include various internal cooling features therein along which a portion of the pressurized air bled from the compressor is channeled, and typically discharged through the airfoil through various film cooling and other holes drilled through any one of the sides, leading and trailing edges, and tip thereof.

Turbine blades are typically cast to near final shape and dimension in a conventional lost wax method. The process starts with a master mold or wax die in which is initially cast a wax form of the entire blade. The internal cooling features of the blade are separately formed in a corresponding core. The core and wax blade are then placed in a suitable mold, and the molten metal displaces the wax around the core and solidifies to form the cast blade.

The cast metal blade then undergoes additional manufacturing steps to obtain the final or finished dimensions thereof, and various holes may then be drilled through the airfoil as required. Since the blades are disposed in a row around the perimeter of the rotor disk, the circumferential width of the individual platforms requires precise dimensions and tolerances to prevent excessively large or narrow gaps therebetween when assembled.

The platform side edges are typically machined to final dimension using a precision grinder. The edge chamfers are then separately formed by using another suitable grinder, such as a pencil grinder, for manually blunting the finished platform side edges to form the chamfers thereat.

This chamfering requires suitable care, and attendant additional cost, to prepare the platforms in final dimension. And, it is subject to its own manufacturing variations. For example, the chamfers should be uniform in extent along the entire side edges of the platforms for accommodating the statistical differences in radial position thereof from platform to platform.

And, since the trailing edge of the individual airfoils is disposed closely adjacent to one of the side edges, the chamfering in this region must be carefully effected to prevent damage to the trailing edge. The trailing edge is subject to high temperature during operation and high stress, and damage thereof where it adjoins the platform edge may require scrapping of the entire blade, with a corresponding waste of manufacturing effort and expense.

Accordingly, it is desired to provide an improved method of making a gas turbine blade with platform chamfers.

BRIEF SUMMARY OF THE INVENTION

A gas turbine blade includes an airfoil, platform, and dovetail. The blade is cast with a chamfer along one edge of the platform thereof. The platform edge is then machined to truncate the chamfer in a simple and precise method.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

Figure 1:
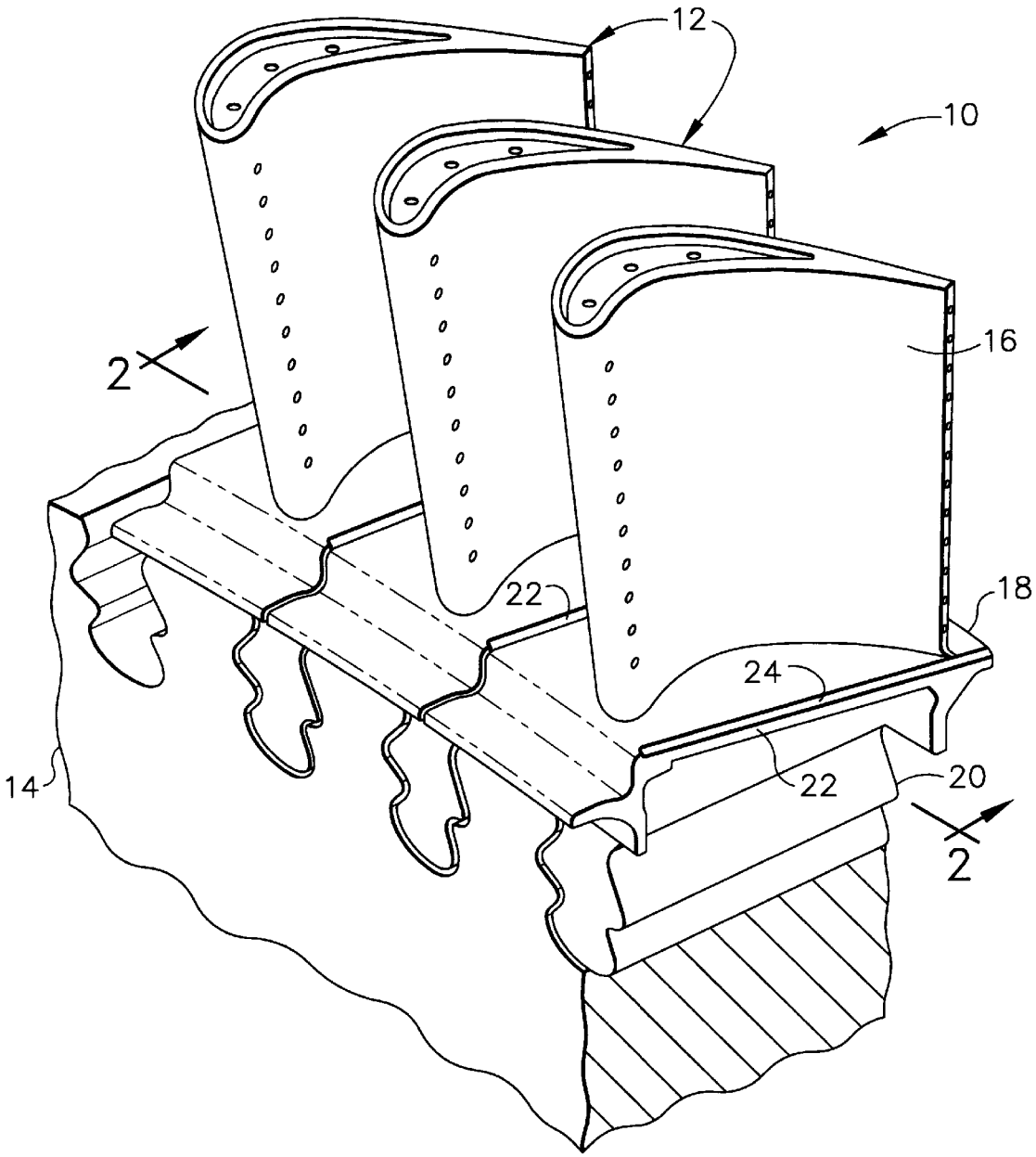
FIG. 1 is a isometric view of a portion of a turbine of a gas turbine engine having a plurality of blades extending radially outwardly from a supporting rotor disk.
Figure 2:
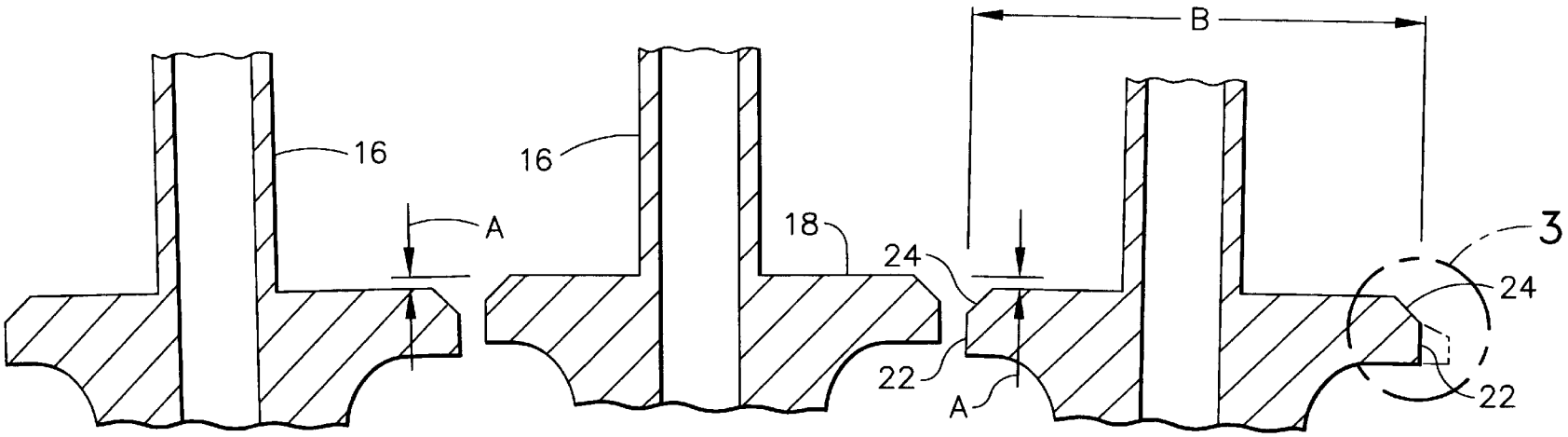
FIG. 2 is an elevational, sectional view through a portion of three adjacent turbine blades illustrated in FIG. 1 and taken along line 2—2 for showing truncated chamfers in accordance with an exemplary embodiment of the present invention.
Figure 3:
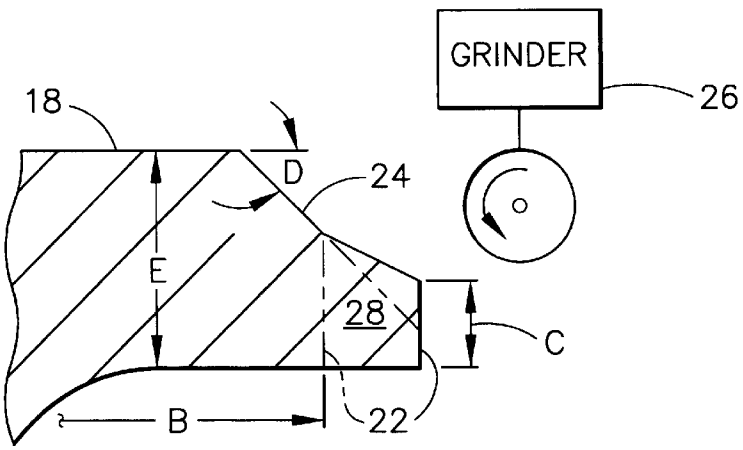
FIG. 3 is an enlarged, elevational sectional view through one of this platform side chamfers illustrated in FIG. 2 within the dashed circle labeled 3 having excess material for being machined away by a grinder shown schematically.
Figure 4:
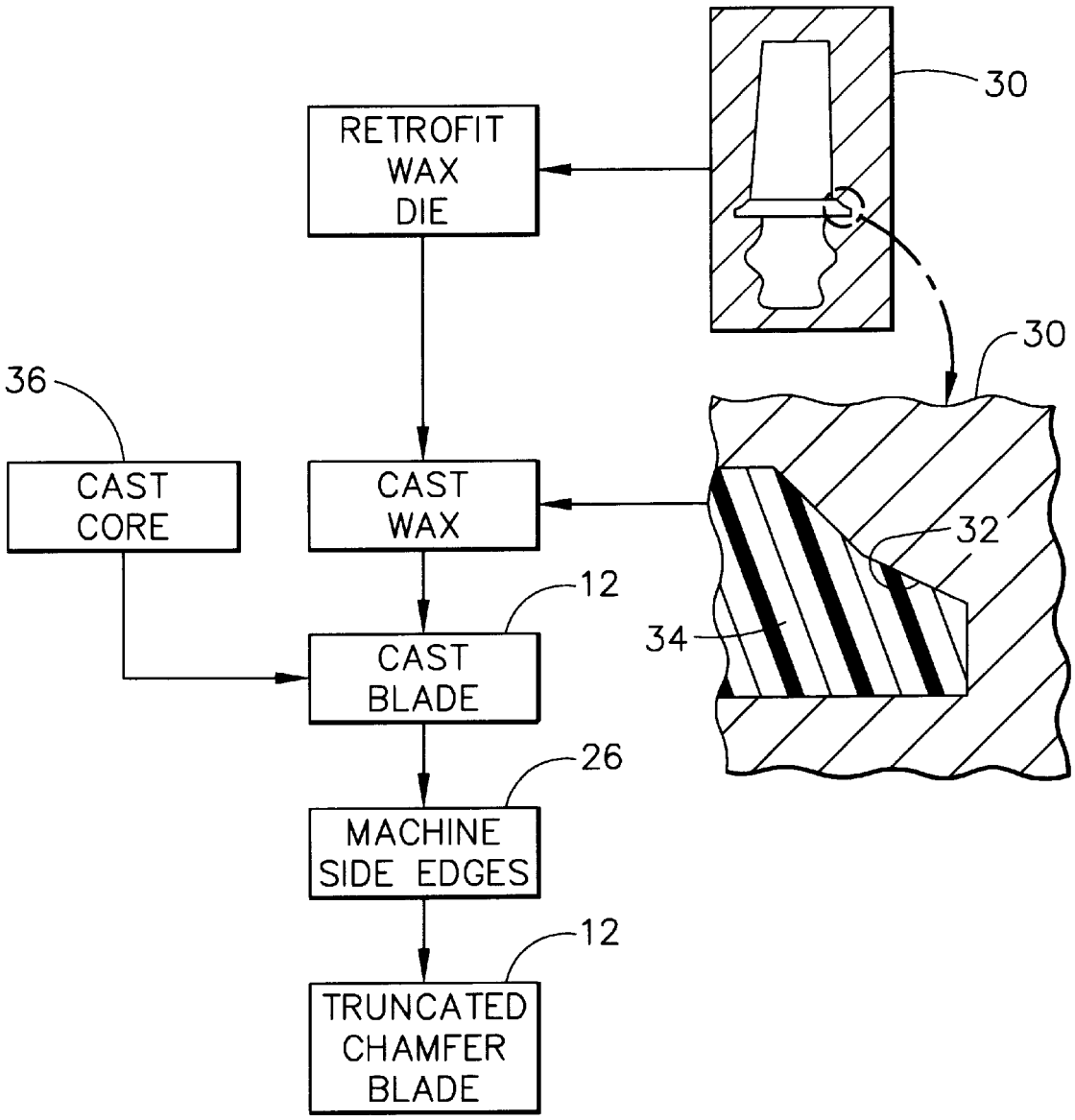

FIG. 4 is a flowchart representation of an exemplary method of making the truncated chamfer turbine blade illustrated in FIGS. 1–3.

DETAILED DESCRIPTION OF THE INVENTION

Illustrated in FIG. 1 is a portion of a turbine 10 of a gas turbine engine. The turbine includes a plurality of circumferential adjoining turbine rotor blades 12 extending radially outwardly from a turbine rotor disk 14.

The several blades are identical in configuration and each includes an airfoil 16, a platform 18 integrally joined to the airfoil, and a dovetail 20 integrally joined to the platform on the radially inner side thereof all in a unitary or one-piece assembly. The rotor 14 includes complementary dovetail slots for retaining the blade dovetails.

The airfoil 16 includes a generally concave pressure side and an opposite generally convex suction side extending axially between leading and trailing edges from root to tip of the airfoil. The airfoil root is disposed on the radially outer surface of the platform 18, with the platform defining tile radially inner flowpath boundary for the combustion gases which flow between the adjacent airfoils during operation.

Each platform 18 includes a pair of circumferentially opposite side edges 22, as well as axially forward and aft edges in the form of cantilevered wings which engage axially adjoining stator components (not shown) for effecting suitable seals therewith.

But for the platform side edges 22, the individual turbine blades 10 may have any conventional form including various cooling features thereof. For example, the blades are typically hollow for circulating therein a portion of air bled from the compressor of the engine for cooling the blades during operation. Each airfoil typically includes serpentine cooling passages therein having various forms of turbulators for enhancing cooling effectiveness of this air channeled inside the blade, with the air being discharged from the airfoil through various holes in any one or more of the airfoil pressure side, suction side, leading and trailing edges, and tip.

As initially shown in FIG. 1, each of the blade platforms 18 includes a cast chamfer 24 extending axially along each of the two platform side edges 22 in accordance with the present invention for accommodating differential radial position of the platforms 18 mounted to the rotor disk. As shown in more detail in FIG. 2, the statistical variation in final dimensions of the individual turbine blades, and the corresponding variation in stack-up tolerances therebetween when assembled to the rotor disk can cause one platform 18 to be radially lower or higher than an adjacent platform. This effects a step difference in radial position of the outer surfaces of the platform represented by the differential radial distance A illustrated in FIG. 2. As indicated above, such platform steps are undesirable since they interrupt the combustion gas flow thereover and lead to local temperature increase along the stepped platform edge.

The adverse effects of the platform step are ameliorated by introducing the side chamfers 24 which provide a smooth transition from platform to platform notwithstanding the differential radial step therebetween.

In accordance with the present invention, the chamfer 24 is a cast feature, unlike the machined chamfer described above in the Background, and is introduced in a new method of manufacture having fewer steps, and correspondingly less cost, with improved dimensional accuracy. This is effected by initially casting the chamfer 24 along the platform side edges 22 and then machining the side edges to a machined precise finish truncating circumferentially short the cast chamfers 24 for achieving a final circumferential width B between the sides of each platform 18.

More specifically, an exemplary as-cast chamfer 24 for the platform side edges 22 is illustrated in more detail in FIG. 3, and a corresponding method of making the turbine blade is illustrated schematically in FIG. 4. As shown in FIG. 4, each of the turbine blades 12 is made by initially casting the blade with a cast chamfer 24 along each side edge 22 of the platform 18 as illustrated in FIG. 3. The platform side edge 22 is then machined using a conventional precision grinder 26, for example, to circumferentially shorten or truncate the cast chamfer to its final dimensions and platform width B.

Since casting technology has a limited manufacturing tolerance, the subsequent machining of the side edges 22 is preferred to control the platform width B to a significantly smaller manufacturing tolerance not available by casting alone. As indicated above, the circumferential width B of the individual platforms 18 is critical to proper assembly and operation of the turbine since the resulting circumferential gaps between the adjacent platforms cannot be too narrow nor too great for proper operation of the turbine.

A particular advantage of the present invention is that the same precision grinder 26 previously used for finishing the platform side edges, without the chamfer in a conventional turbine blade, may also be used to effect that same operation with the platforms 18 having the cast chamfers 24. In this way, the single grinding operation along each platform side edge 22 effects the final finish and dimension of the side edge 22, as well as truncating the cast chamfer 24 to a suitable remaining chamfer width. The chamfer 24 itself is sufficiently accurate as cast, and does not require precision machining for effectiveness. However, the platform side edges 22 do require precision machining thereof for effective use in the turbine.

As shown in FIG. 3, the chamfer 24 extends from the radially outer surface of the platform 18 toward the radially inner surface thereof, and meets the platform side edge 22 at a suitable radial height C therebetween.

As illustrated in FIG. 1, each airfoil 16 includes an arcuate leading edge at the axially forward side of the disk, and a narrow, sharp trailing edge at the axially aft side of the disk. The airfoil 16 is typically twisted radially, with the trailing edge being closely adjacent to the pressure side edge 22 of the platform 18. The platform side edge 22, along with the chamfer 24, thusly extends between the leading and trailing edges of the airfoil over the majority of the platform 18 that defines the combustion gas inner flowpath boundary.

The suction side edge 22 of each platform 18 similarly extends between the airfoil leading and trailing edges, but since the airfoil is convex near this edge, the leading and trailing edges are spaced circumferentially away from the suction side edge 22. Accordingly, the pressure side edge 22 is disposed relatively close to the airfoil trailing edge which requires precise location of the chamfer 24 to prevent any stress concentration at the airfoil root. Since the chamfers 24 are cast along with the remainder of the blade 12, they may be precisely located along the respective side edges 22 without being unacceptably close to the airfoil trailing edge near its root.

Furthermore, and as shown in FIG. 2, both platform side edges 22 are machined to truncate both cast chamfers 24 to obtain the finished or final width B of the platform therebetween. Accordingly, not only are the chamfers 24 precisely formed along the two side edges of the individual platforms 18, but the single machining operation along each side edge is sufficient for both completing the width of the individual chamfers, as well as precisely finishing the opposite side edges 22 to final platform width.

As shown in more detail in FIG. 3, the cast chamfer 24 may have any suitable configuration and preferably has an inclination angle D from the platform outer surface of about 45°. In order to allow the final machining; of the side edges 22, each edge correspondingly includes excess material 28 circumferentially therealong which is removed by the grinder 26. The platform 18 has a maximum thickness E near the side edges 22 which is reduced to the smaller edge thickness C by the cast chamfer 24. Since the platform thickness E is relatively small, a chamfered edge thickness C is substantially smaller. If the height of the excess material 28 is too small, the side edge 22 cannot be cast without undesirably damaging the side edge 22.

Accordingly, the cast chamfer 24 illustrated in FIG. 3 is preferably generally concave in circumferential section before machining the side edge 22. This concave section may be effected by forming the chamfer 24 in two flat sections joined together at an obtuse included angle. In this way, the chamfer angle in the excess material 28 is less than the nominal chamfer angle D and increases the initial height C of the unmachined side edge 22 to greater than what it would otherwise be for a continuously flat chamfer 24 shown in phantom in FIG. 3. The height C of the side edge 22 may be as little as about 0.5 mm which allows the chamfer 24 to be initially cast with the entire blade 12 as described in more detail hereinbelow.

FIG. 3 illustrates the platform side edge 22 and chamfer 24 therealong in solid line in the as-cast condition prior to machining, and in part phantom line after machining the side edge 22 to the final platform width 13, with the resulting chamfer 24 being substantially flat or straight in section. Although the initial cast chamfer 24 has two different chamfer angles, removal of the excess material 28 eliminates the second chamfer angle, leaving the chamfer 24 with a single chamfer angle, and single substantially flat surface.

The platform side edges 22 including the cast chamfers 24 therein may be initially cast in any conventional manner. However, a particular advantage of the present invention is the ability to readily easily retrofit existing equipment and casting processes for inexpensively introducing the cast chamfer feature. As shown in FIG. 4, an existing and conventional wax die or mold 30 may be readily retrofitted by machining therein a corresponding pocket 32 being complementary with the configuration of the side edge 22 and chamfer 24 illustrated in FIG. 3 for the casting thereof.

The master die 30 so retrofitted, is then used to cast a wax blade 34 having a platform, side edges 22, and chamfers 24 substantially identical to the metal counterparts illustrated in FIG. 3, but in wax.

A suitable ceramic core 36 is separately cast for producing the various internal cooling features of the blade. The cast core 36 and wax blade 34 are then combined for casting the metallic blade 12 in the conventional lost wax method.

The resulting cast blade 12 includes the cast chamfer 24 and excess material 28 illustrated in FIG. 3 and provides an improved intermediate blade prior to being finished. The side edges 22 are then finally machined as illustrated in FIG. 3 for eliminating the excess material along each edge leaving behind only the cast chamfers 24. The so truncated cast blade 12 enjoys a more uniform chamfer 24 as compared with the conventional ground version thereof, along with the required precise platform width B and finished edges 22.

The cast chamfer 24 and machined side edges 22 significantly simplify the manufacturing process, reduce cost, and improve manufacturing accuracy for effecting an improved turbine blade 12. And, the cast chamfer 24 may be readily re-worked or retrofitted in an otherwise conventional turbine blade wax die and thereby added to an existing production turbine blade design at minimum cost.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A method of making a gas turbine blade having an airfoil, platform, and dovetail comprising:

casting said blade with a chamfer along one edge of said platform; and machining said platform edge to truncate said chamfer.

2. A method according to claim 1 wherein said chamfer extends from a radially outer surface of said platform toward a radially inner surface thereof.

3. A method according to claim 2 wherein:

said airfoil includes leading and trailing edges; and said platform edge is a circumferential side edge along which said chamfer extends between said leading and trailing edges.

4. A method according to claim 3 wherein:

said platform includes a circumferentially opposite pair of said side edges and chamfers extending therealong; and both said side edges are machined to truncate both said chamfers to obtain a finished width of said platform therebetween.

5. A method according to claim 4 wherein said cast chamfer is generally concave in section before machining said side edge.

6. A method according to claim 5 wherein said chamfer is substantially flat in section after machining said side edge.

7. A turbine blade made by the method of claim 6.

8. A method according to claim 5 wherein said concave cast chamfer comprises two flat sections joined together at an obtuse included angle.

9. A method according to claim 8 wherein said cast chamfer has a chamfer angle along one of said two flat sections, and includes excess material having a smaller chamfer angle along the other one of said two flat sections.

10. A method according to claim 9 wherein said platform edge is machined to remove said excess chamfer material.

11. A turbine blade made by the method of claim 10.

12. A turbine blade made by the method of claim 8.

13. A turbine blade made by the method of claim 5.

14. A method according to claim 3 wherein said blade casting comprises:

retrofitting a wax die for said turbine blade to additionally include a pocket for casting said side edge and chamfer;

casting a wax turbine blade in said wax die; and casting said turbine blade in metal using said wax turbine blade.

15. A method according to claim 14 wherein said die pocket includes two flat section joined together at an obtuse included angle for casting said chamfer.

16. A turbine blade made by the method of claim 3.

17. A gas turbine blade comprising:

an airfoil;

a platform integrally joined to said airfoil;

a dovetail integrally joined to said platform; and said platform including a pair of opposite side edges, each having a cast chamfer extending therealong and a machined finished truncating said cast chamfer.

18. A blade according to claim 17 wherein said chamfers extend from a radially outer surface of said platform toward a radially inner surface thereof.

19. A blade according to claim 18 wherein:

said airfoil includes leading and trailing edges; and said platform edges are circumferential side edges along which said chamfers extend between said leading and trailing edges.

* * * * *